US008550012B2

(12) United States Patent
Rogers et al.

(10) Patent No.: US 8,550,012 B2
(45) Date of Patent: Oct. 8, 2013

(54) LEG LOCKING AND FOLDING MECHANISM FOR FOLDING TABLE

(75) Inventors: Grant Rogers, Sanford, MI (US); Richard D. Smith, Spanish Fork, UT (US)

(73) Assignee: Mity-Lite, Inc., Orem, UT (US)

( * ) Notice: Subject to any disclaimer, the term of this patent is extended or adjusted under 35 U.S.C. 154(b) by 0 days.

(21) Appl. No.: 13/283,130

(22) Filed: Oct. 27, 2011

(65) Prior Publication Data

US 2013/0104782 A1 May 2, 2013

(51) Int. Cl.
*A47B 3/00* (2006.01)

(52) U.S. Cl.
USPC ..... 108/132; 108/131

(58) Field of Classification Search
USPC ..... 108/132, 133, 129, 130, 131; 248/188.6, 188.91
See application file for complete search history.

(56) References Cited

U.S. PATENT DOCUMENTS

| | | | | |
|---|---|---|---|---|
| 50,891 | A | | 11/1856 | Batchelor |
| 158,063 | A | | 12/1874 | Grimm |
| 811,209 | A | | 1/1906 | Farrell |
| 827,834 | A | | 8/1906 | Westby |
| 953,413 | A | | 3/1910 | Eggers |
| 1,007,727 | A | | 11/1911 | Onken |
| 1,335,704 | A | | 3/1920 | Russell et al. |
| 1,439,002 | A | | 12/1922 | Jourdan |
| 1,526,009 | A | | 2/1925 | Partington |
| 1,542,138 | A | | 6/1925 | Hunter |
| 1,641,495 | A | | 9/1927 | Krick |
| 1,646,175 | A | | 10/1927 | Thiede |
| 1,684,966 | A | | 9/1928 | O'Conor |
| 1,801,080 | A | | 4/1931 | Hart et al. |
| 1,860,644 | A | | 5/1932 | Bales et al. |
| 1,888,117 | A | * | 11/1932 | Fox ..... 108/133 |
| 1,891,734 | A | | 12/1932 | Slee |
| 2,162,777 | A | | 6/1939 | Hagopian |
| 2,278,331 | A | | 3/1942 | Mayercord |
| 2,304,718 | A | | 12/1942 | Swart |
| 2,358,174 | A | | 9/1944 | McFall |
| 2,374,670 | A | * | 5/1945 | Duke ..... 108/133 |
| 2,535,920 | A | | 12/1950 | Hart et al. |
| 2,539,461 | A | | 1/1951 | Norquist |

(Continued)

FOREIGN PATENT DOCUMENTS

| | | |
|---|---|---|
| DE | 3641967 | 10/1987 |
| EP | 2227984 | 9/2010 |

OTHER PUBLICATIONS

Web Page: www.Amazon.com: Eastman Outdoors Aluminum Folding Table/dp/B00006JEGG; printed Jan. 26, 2009; 7 pages.

(Continued)

*Primary Examiner* — Jose V Chen
(74) *Attorney, Agent, or Firm* — Thorpe North & Western LLP

(57) ABSTRACT

A folding table has a leg pivotally coupled to a bottom of a tabletop. A pair of links is pivotally coupled together and pivotally coupled in series between the tabletop and the leg. The pair of links, the tabletop and the leg form a four-bar, four-pivot linkage, including four pivots and four bars defined between the pivots. The bars of the linkage are sized and the pivots of the linkage are located to resist movement of the linkage through an intermediate binding configuration between open and closed configurations.

22 Claims, 7 Drawing Sheets

(56) References Cited

U.S. PATENT DOCUMENTS 2,542,860 A 2/1951 Clements
2,650,185 A 8/1953 Larson et al.
2,681,261 A 10/1953 Blink
2,657,964 A 11/1953 Watrous
2,690,369 A 9/1954 Laskey et al.
2,714,743 A 8/1955 Lochner
2,786,727 A 3/1957 Nordmark
2,815,529 A 12/1957 Herbolsheimer et al.
2,851,322 A 9/1958 Molla
2,889,184 A 6/1959 Golff
2,889,185 A 6/1959 Heisler
2,905,334 A 9/1959 Gottschalk et al.
2,940,805 A 6/1960 Nordmark
2,978,895 A 4/1961 Heisler
2,996,764 A 8/1961 Ross et al.
3,021,575 A 2/1962 Heisler
3,061,369 A 10/1962 Haunost
3,065,860 A 11/1962 Swanson
3,074,770 A 1/1963 Joos
3,086,657 A 4/1963 Myers
3,150,032 A 9/1964 Rubenstein
3,159,114 A 12/1964 Haunost
3,164,110 A 1/1965 Bofinger
3,174,893 A 3/1965 Church et al.
3,190,649 A 6/1965 Heisler
3,213,570 A 10/1965 Abramson, Jr
3,219,401 A 11/1965 Mapson
3,223,056 A 12/1965 Wilburn
3,328,500 A 6/1967 Barnette
3,337,662 A 8/1967 Spencer
3,351,369 A * 11/1967 Hogstrom ..... 108/133
3,475,030 A 10/1969 Prescott
3,610,175 A 10/1971 Wilton et al.
3,622,216 A 11/1971 Haunost
3,628,470 A 12/1971 DeLuca
3,698,329 A 10/1972 Diamond et al.
3,700,533 A 10/1972 Schmitz
3,724,078 A 4/1973 Carlin et al.
3,761,554 A 9/1973 Barnette
3,832,264 A 8/1974 Barnette
3,836,043 A 9/1974 Levin
3,837,298 A 9/1974 Leonhart
3,856,451 A 12/1974 Holzinger
3,880,092 A 4/1975 Seeber et al.
3,915,098 A 10/1975 Nania
3,920,295 A 11/1975 Speckin
3,960,354 A 6/1976 Simikoski
3,962,390 A 6/1976 Mori et al.
3,971,181 A 7/1976 Zetlin
3,999,397 A 12/1976 Albery
4,099,887 A 7/1978 Mackenroth
4,101,233 A 7/1978 McConnell
4,111,482 A 9/1978 Jones
4,112,855 A 9/1978 Colby
4,138,953 A 2/1979 Tashman
4,278,196 A 7/1981 Ford
4,337,107 A 6/1982 Eshleman
4,341,164 A 7/1982 Johnson
4,397,247 A 8/1983 Lemelson
4,446,796 A 5/1984 Wilson et al.
4,503,780 A 3/1985 Apissomian
D280,371 S 9/1985 Bayly
2,860,383 A 11/1985 Heisler
4,560,523 A 12/1985 Plumley et al.
4,569,496 A 2/1986 Fleishman
4,606,170 A 8/1986 Mendenhall
4,646,654 A 3/1987 Sullivan
4,671,753 A 6/1987 Payne
4,676,041 A 6/1987 Ford
4,689,257 A 8/1987 Baum
4,696,406 A 9/1987 Karashima
4,706,436 A 11/1987 Mabey et al.
4,708,183 A 11/1987 Figueroa
4,715,503 A 12/1987 Johnson
4,727,816 A 3/1988 Virtue
4,735,151 A 4/1988 Bisbing
4,749,533 A 6/1988 Payne
4,750,432 A 6/1988 McNamara et al.
4,805,541 A 2/1989 Drane et al.
4,809,755 A 3/1989 Pontikas
4,827,850 A 5/1989 Diffrient
4,841,877 A 6/1989 Virtue
4,883,001 A 11/1989 Roth
4,904,022 A 2/1990 Morozzi
4,927,107 A 5/1990 Mateo Maria
4,998,697 A 3/1991 Esposito
5,011,636 A 4/1991 Payne
5,044,690 A 9/1991 Torrey
5,081,725 A 1/1992 Neese
5,102,077 A 4/1992 Glendinning
5,114,265 A 5/1992 Grisley
5,142,996 A 9/1992 Thorn
5,152,481 A 10/1992 Cote et al.
5,152,591 A 10/1992 Beals
5,173,348 A 12/1992 Gevaert et al.
5,213,861 A 5/1993 Severson et al.
5,241,914 A 9/1993 Korb
D341,271 S 11/1993 Pesso
5,259,305 A 11/1993 Korb
5,271,338 A 12/1993 Bonham
5,284,100 A 2/1994 Thorn
5,311,825 A 5/1994 Bonham
5,320,048 A 6/1994 Feiner
5,362,063 A 11/1994 Cummings
5,366,675 A 11/1994 Needham
5,374,180 A 12/1994 Bauer
5,389,316 A 2/1995 Kerman
5,394,808 A 3/1995 Dutro et al.
5,436,048 A 7/1995 Meier et al.
5,440,857 A 8/1995 Shanok et al.
5,443,020 A 8/1995 Price
5,464,305 A 11/1995 Liem
5,473,997 A 12/1995 Solomon et al.
5,490,467 A 2/1996 Diffrient
5,527,579 A 6/1996 Aho
5,532,282 A 7/1996 Needham
5,549,055 A 8/1996 Kusch
5,562,051 A 10/1996 Rizzi
D377,723 S 2/1997 Schacht
5,638,761 A 6/1997 Berkowitz et al.
5,678,491 A 10/1997 Price et al.
5,694,865 A 12/1997 Raab
5,709,155 A 1/1998 Terracciano
5,732,637 A 3/1998 Raab
5,759,472 A 6/1998 DeFranco et al.
5,783,611 A 7/1998 Strebel
5,865,128 A * 2/1999 Tarnay ..... 108/133
5,868,081 A 2/1999 Raab
5,871,219 A 2/1999 Elliot
5,888,114 A 3/1999 Slocum et al.
D412,254 S 7/1999 Gower
5,928,584 A 7/1999 Lee et al.
5,947,037 A 9/1999 Hornberger et al.
5,964,165 A 10/1999 Schmidt et al.
5,983,807 A 11/1999 Tarnay et al.
6,018,927 A 2/2000 Major
6,024,903 A 2/2000 Naft et al.
6,058,854 A 5/2000 Tarnay et al.
6,083,434 A 7/2000 Strebel
6,127,019 A 10/2000 Means
6,180,203 B1 1/2001 Unkles
6,199,489 B1 3/2001 Tsai
6,245,266 B1 6/2001 Ramesh
6,261,490 B1 7/2001 Kliene
D448,938 S 10/2001 Ng et al.
6,308,469 B1 10/2001 Leung
6,334,504 B1 1/2002 Sato et al.
D456,155 S 4/2002 DeVriendt
6,389,989 B1 5/2002 Hagerty
6,401,631 B1 6/2002 Kane et al.
6,536,359 B2 3/2003 Liu
6,615,743 B2 9/2003 Nien
6,694,897 B2 2/2004 Lou-Hao
6,712,009 B2 3/2004 Buntre et al.

(56) References Cited

U.S. PATENT DOCUMENTS

| | | | | |
|---|---|---|---|---|
| 6,772,700 | B2 * | 8/2004 | Wong | 108/133 |
| 6,824,860 | B2 | 11/2004 | Edwards et al. | |
| 6,837,171 | B1 | 1/2005 | Clark et al. | |
| 6,848,370 | B1 | 2/2005 | Stanford | |
| 6,892,860 | B2 | 5/2005 | Gibson et al. | |
| 6,901,867 | B2 | 6/2005 | Strong et al. | |
| 6,915,748 | B2 | 7/2005 | Stanford | |
| 6,915,749 | B2 | 7/2005 | Chang | |
| 6,920,833 | B2 * | 7/2005 | Lou-Hao | 108/133 |
| 6,959,651 | B2 | 11/2005 | Li | |
| 6,971,321 | B1 * | 12/2005 | Strong et al. | 108/133 |
| D519,746 | S | 5/2006 | Ng et al. | |
| 7,059,255 | B2 | 6/2006 | Tsai | |
| 7,143,702 | B2 | 12/2006 | Stanford | |
| 7,150,237 | B2 | 12/2006 | Lin et al. | |
| 7,157,034 | B2 | 1/2007 | Bristow et al. | |
| 7,171,911 | B1 | 2/2007 | Rivera, Jr. et al. | |
| 7,178,471 | B2 | 2/2007 | Strong et al. | |
| D541,549 | S | 5/2007 | Ng et al. | |
| 7,229,231 | B2 | 6/2007 | Yu | |
| 7,251,920 | B2 | 8/2007 | Timmerman et al. | |
| 7,270,062 | B1 | 9/2007 | Larson | |
| 7,278,361 | B2 | 10/2007 | Zhurong et al. | |
| 7,360,343 | B1 | 4/2008 | Spransy et al. | |
| 7,361,123 | B1 | 4/2008 | Krull | |
| 7,472,655 | B2 | 1/2009 | Leng | |
| 7,509,914 | B2 * | 3/2009 | Murphy | 108/133 |
| 7,530,142 | B2 | 5/2009 | Sutterlutti et al. | |
| 7,641,414 | B1 | 1/2010 | Joyce | |
| 7,703,398 | B2 | 4/2010 | Brauning et al. | |
| 8,297,208 | B2 * | 10/2012 | Hoffman | 108/133 |
| 2002/0096094 | A1 | 7/2002 | Lira | |
| 2002/0152934 | A1 | 10/2002 | Haney | |
| 2002/0170470 | A1 | 11/2002 | Cheng | |
| 2003/0044231 | A1 | 3/2003 | Anvick | |
| 2004/0045488 | A1 | 3/2004 | Danzik et al. | |
| 2004/0159622 | A1 | 8/2004 | Craft et al. | |
| 2005/0129921 | A1 | 6/2005 | Laws et al. | |
| 2005/0184419 | A1 | 8/2005 | Laws et al. | |
| 2005/0274306 | A1 | 12/2005 | Strong | |
| 2006/0032417 | A1 | 2/2006 | Goschy et al. | |
| 2006/0081158 | A1 | 4/2006 | Ingham | |
| 2006/0117702 | A1 | 6/2006 | Lin | |
| 2006/0260519 | A1 | 11/2006 | Burns | |
| 2007/0039523 | A1 | 2/2007 | Helzer et al. | |
| 2007/0157857 | A1 | 7/2007 | Bottemiller | |
| 2007/0227412 | A1 | 10/2007 | Voris | |
| 2007/0227416 | A1 | 10/2007 | Wang | |
| 2007/0256614 | A1 | 11/2007 | Chen | |
| 2008/0211128 | A1 | 9/2008 | Lucier et al. | |
| 2008/0258514 | A1 | 10/2008 | Nichols et al. | |
| 2009/0078173 | A1 | 3/2009 | Topham et al. | |
| 2009/0199746 | A1 | 8/2009 | Horton | |
| 2010/0186638 | A1 | 7/2010 | Roy et al. | |
| 2010/0275822 | A1 | 11/2010 | Elford | |

OTHER PUBLICATIONS

Web Page: www.bristrotablesandbases.com/woodard/woven.htm; printed Jan. 26, 2006; 2 pgs.

Web Page: www.southernaluminum.com/catalog/pages/page1_p.html; printed Jan. 26, 2009; 13 pages.

Web Page: www.southernaluminum.com/alulite_tables/benefits.html: printed Jan. 26, 2009; 4 pgs.

Web Page: www.jointech.com/tablesaw_fl . . . Saw Train Floating Tables; printed Oct. 6, 2008; 3 pgs.

Web Page www.southernaluminum.com/alulite_tables/specifications.HTML: printed Jan. 26, 2009; 2pgs.

Web Page: www.tropitone.com; printed Jan. 26, 2009; 2 pgs.

Southern Aluminum, Installation and Product Photos; http://www.southernaluminum.com/gallery.php?9num; as accessed on Feb. 17, 2011; 1 page.

Southern Aluminum, Installation and Product Photos; http://www.southernaluminum.com/gallery.php?9num; as accessed Feb. 17, 2011; 1 page.

http://www.southernaluminum.com/catalog/pages/page6_p.html; as accessed on Feb. 17, 2011; 1 page.

T2 [two tables in one]; http://www.southernaluminum.com/t2/specifications.html; as accessed Feb. 17, 2011; 1 page.

T2 [two tables in one]; http://www.southernaluminum.com/t2/specifications.html; as accessed on Feb. 17, 2011; 1 page.

U.S. Appl. No. 13/283,077, filed Oct. 27, 2011; Richard D. Smith.

U.S. Appl. No. 13/283,077, filed Oct. 27, 2011; Richard D. Smith; office action dated Apr. 26, 2013.

* cited by examiner 22
40
10
14
44
38
48
18
34
(a)
44
40
52
48
38
34
(b)
52
48
44
34
(c)
(d)
(e)
48
40
22
18
34
38
(f)

LEG LOCKING AND FOLDING MECHANISM FOR FOLDING TABLE

BACKGROUND

1. Field of the Invention

The present invention relates generally to folding tables and folding leg mechanisms thereof.

2. Related Art

Folding tables often have legs or leg assemblies pivotally coupled to a tabletop, and a mechanism for locking or holding the legs in an open or extended position.

SUMMARY OF THE INVENTION

It has been recognized that it would be advantageous to develop a folding table with a leg locking or holding mechanism to maintain the legs in a closed position.

The invention provides a folding table device with a leg pivotally coupled to a bottom of a tabletop. A pair of links is pivotally coupled together and pivotally coupled in series between the tabletop and the leg. The pair of links, the tabletop and the leg form a four-bar, four-pivot linkage, including four pivots and four bars defined between the pivots. The bars of the linkage are sized and the pivots of the linkage are located to resist movement of the linkage through an intermediate binding configuration between open and closed configurations.

In accordance with a more detailed aspect of the invention, the at least one of the pivots can be a movable or bendable pivot in the intermediate binding configuration to allow the linkage to move through the intermediate binding configuration between the open and closed configurations. A flexible and resilient clamp band can couple a pivot axel of the leg to the bottom of the tabletop. The clamp band can be flexible and resilient to allow the pivot axel to move in the intermediate binding configuration to allow the linkage to move through the intermediate binding configuration between the open and closed configurations.

In accordance with another more detailed aspect of the invention, one of the pair of links can abut the leg in the intermediate binding configuration between the open and closed configurations to resist movement of the linkage between the open and closed configurations.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

DETAILED DESCRIPTION OF EXAMPLE EMBODIMENT(S)

Definitions

The term "folding table" is used herein to refer to a table with legs that fold against or into the table to create a reduced thickness for storage, and that fold away from the table to support a tabletop in a horizontal orientation above a support surface.

The term "support surface" and "ground" are used interchangeably herein to refer to a support surface, such as the ground, a floor, a stage, a platform, etc. upon which the table is disposed or supported.

DESCRIPTION

As illustrated in FIGS. 1*a*-4, a folding table, indicated generally at 10, in an example implementation in accordance with the invention is shown with a folding mechanism 14 that resists movement of the legs through an intermediate binding configuration between open and closed configurations.

Figure 1A:
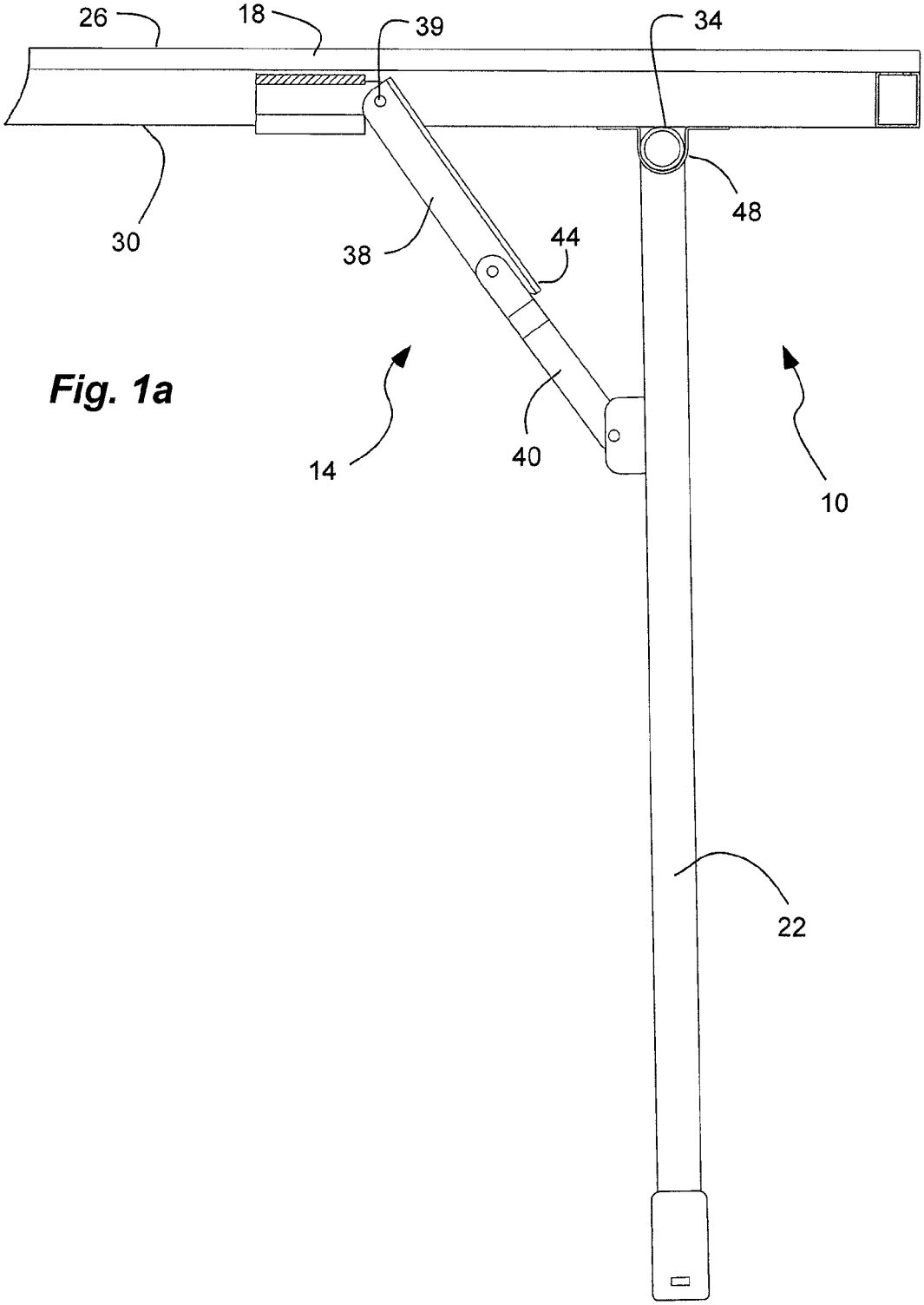
FIG. 1*a* is a partial cross-sectional front view of a folding table in accordance with an embodiment of the present invention taken along line 1*a* in FIG. 3, showing a leg in an open extended orientation, a pair of links in an extended configuration, and a linkage in an open configuration.
Figure 1B:
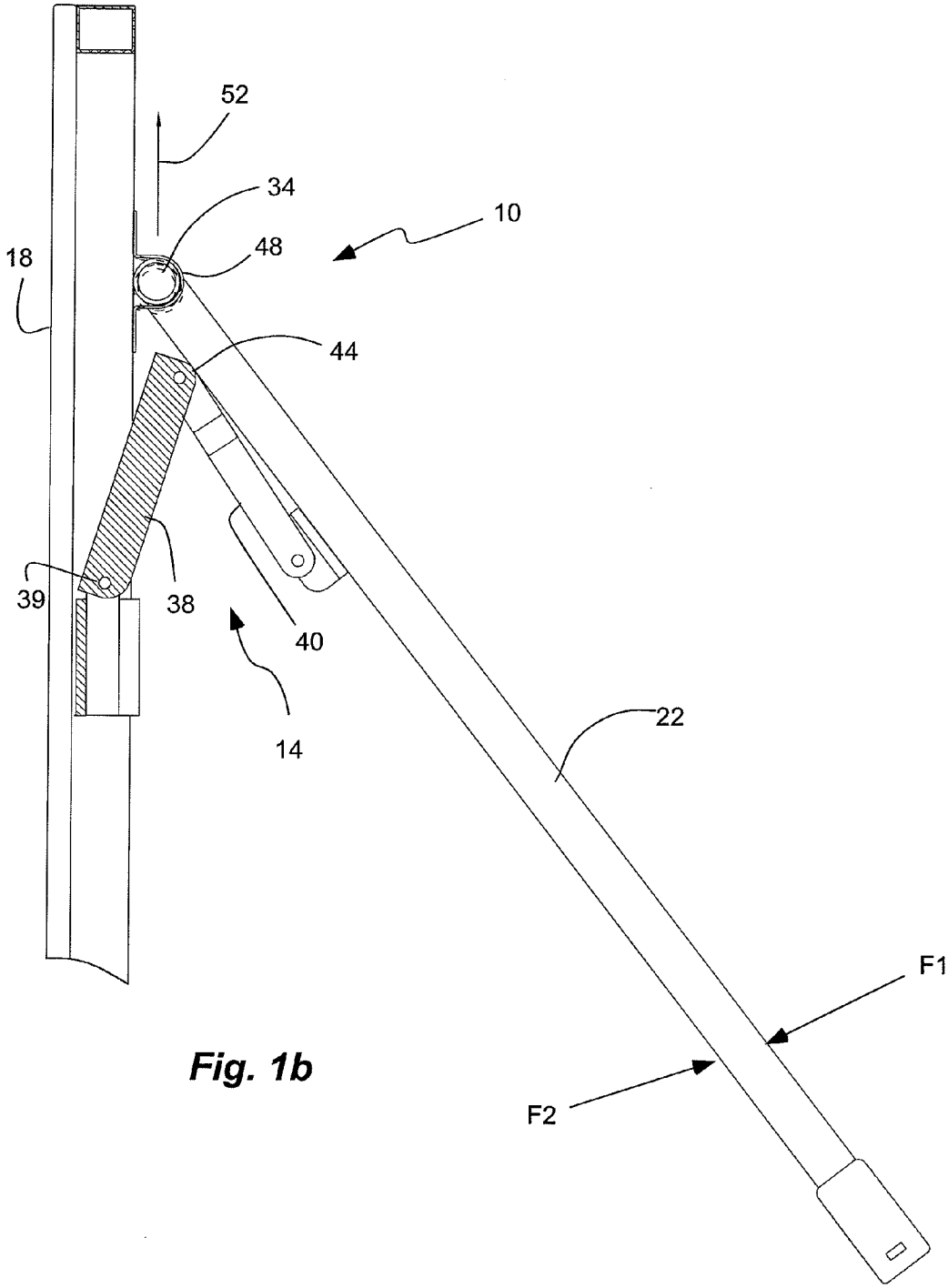
FIGS. 1*b*-1*e* are schematic partial cross-sectional front views of the folding table of FIG. 1 a showing the linkage in one or more intermediate configurations.
Figure 1C:
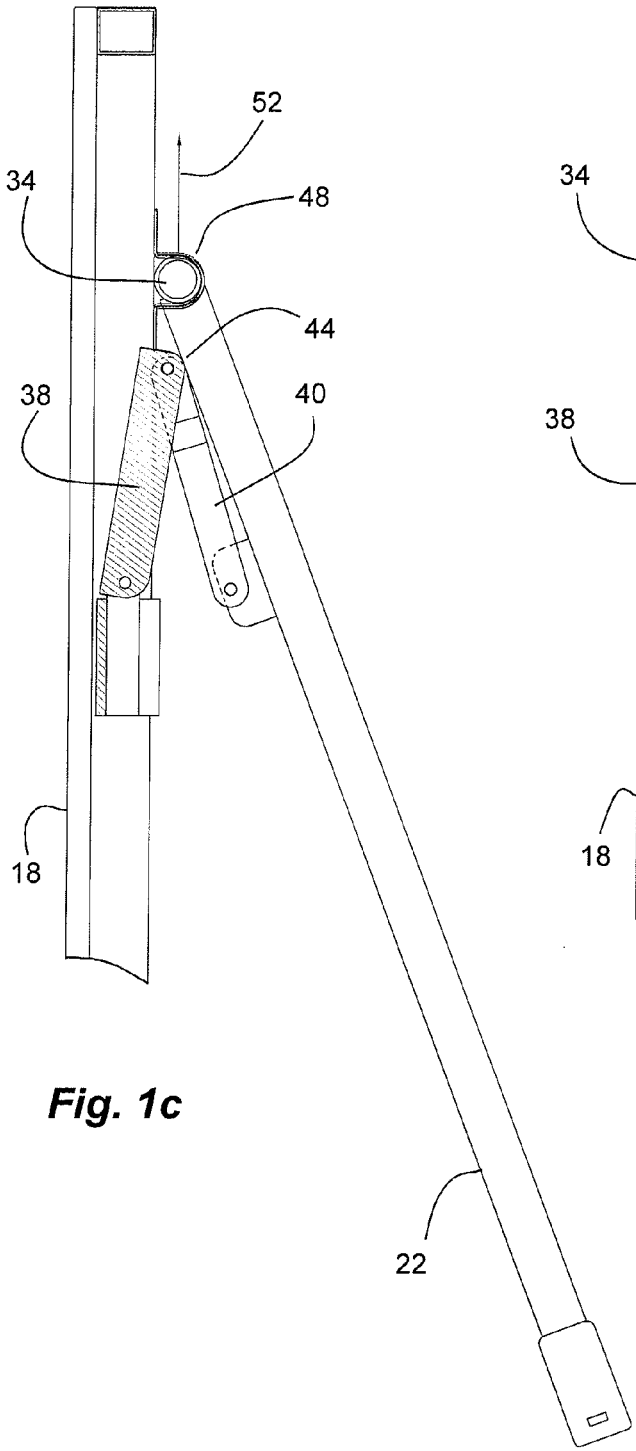
Figure 1D:
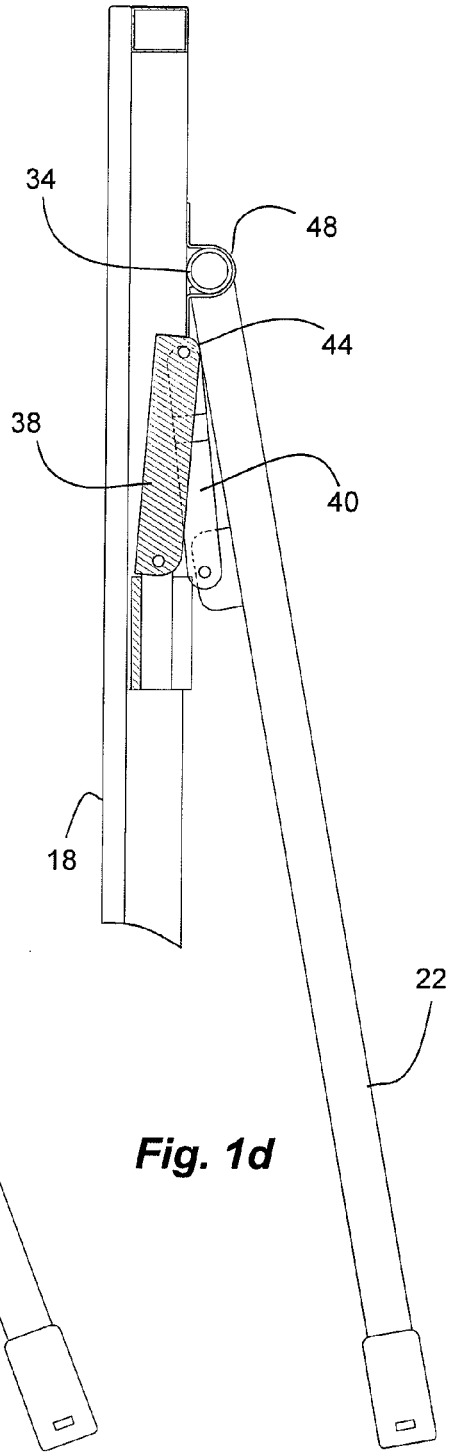
Figure 1E:
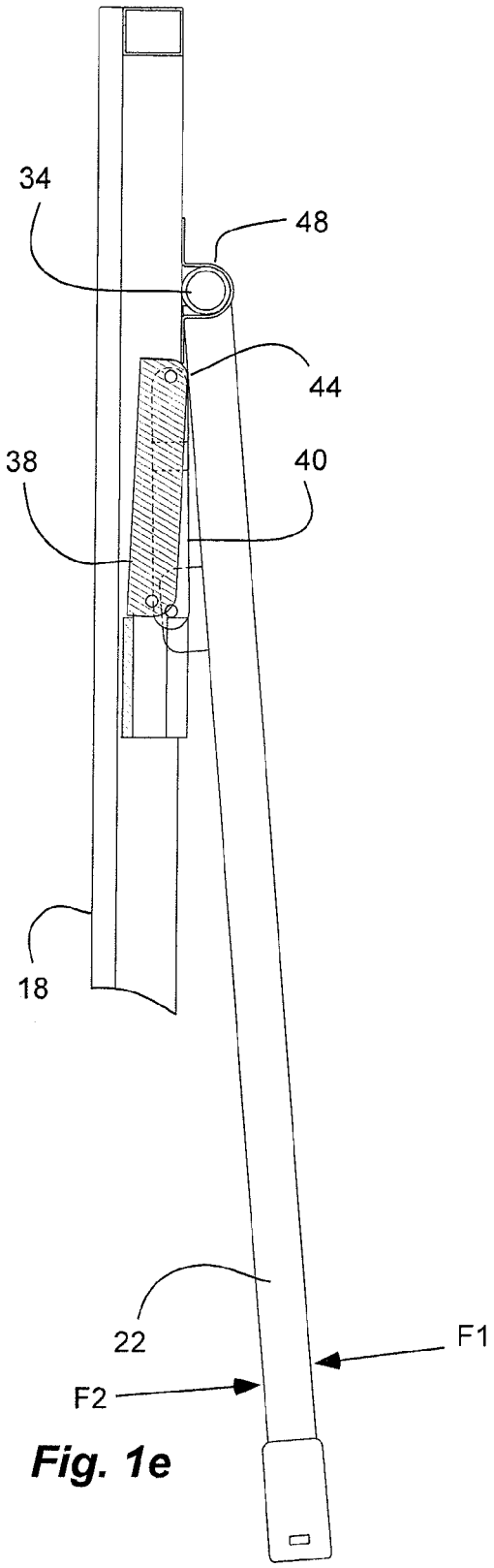
Figure 1F:
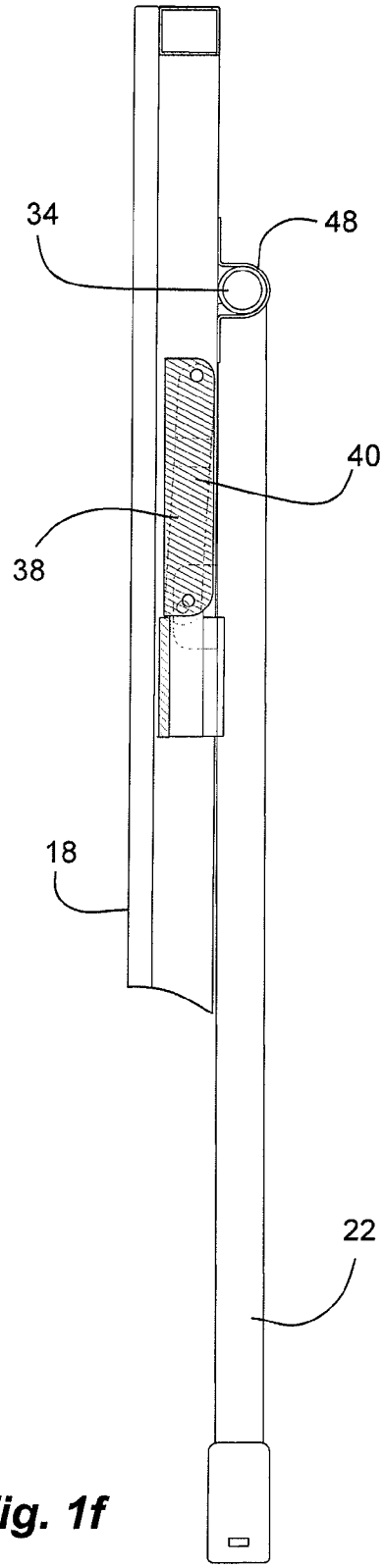
FIG. 1*f* is a schematic partial cross-sectional front view of the folding table of FIG. 1*a*, showing the leg in a closed retracted orientation, the pair of links in a retracted configuration, and the linkage in a closed configuration.
Figure 2:
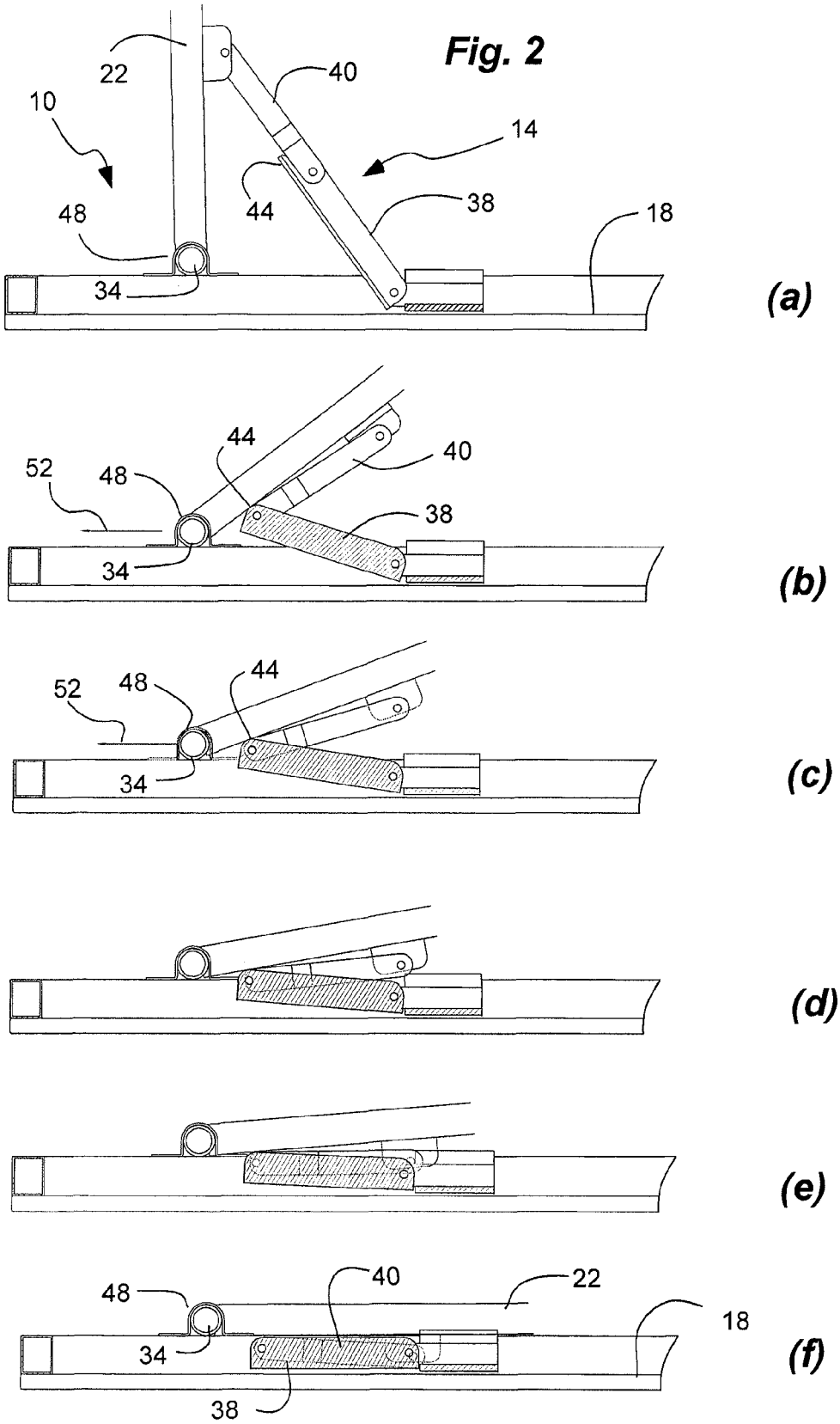
FIGS. 2*a*-*f* are detailed schematic views of the folding table of FIG. 1*a* corresponding to FIGS. 1*a*-*f;*
Figure 3:
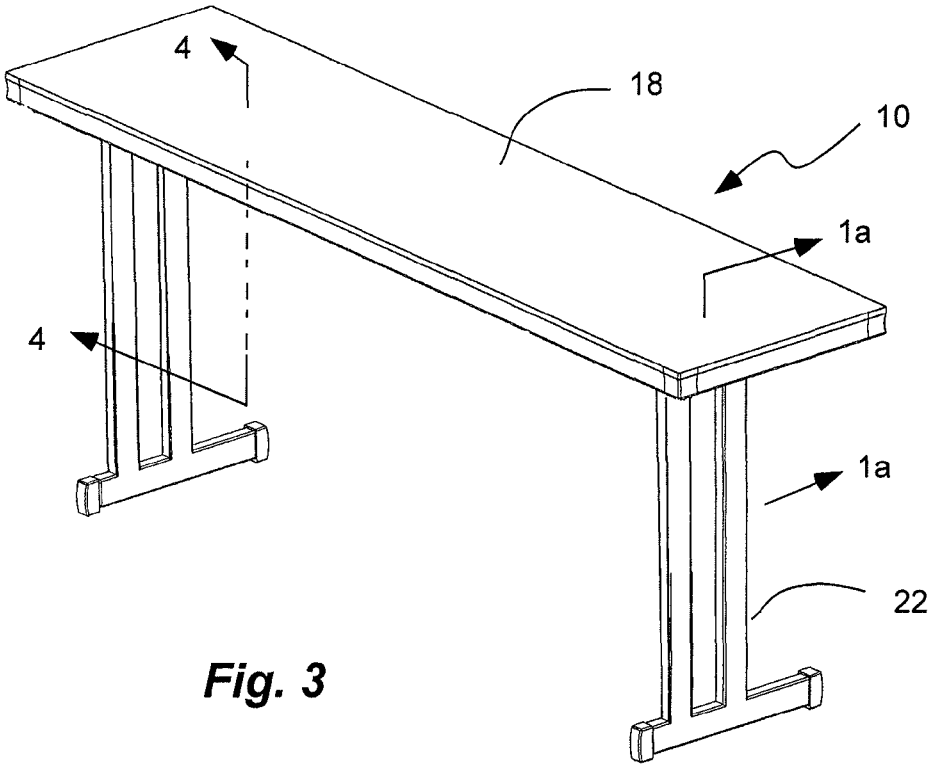
FIG. 3 is a front perspective view of the folding table of FIG. 1*a;*
Figure 4:
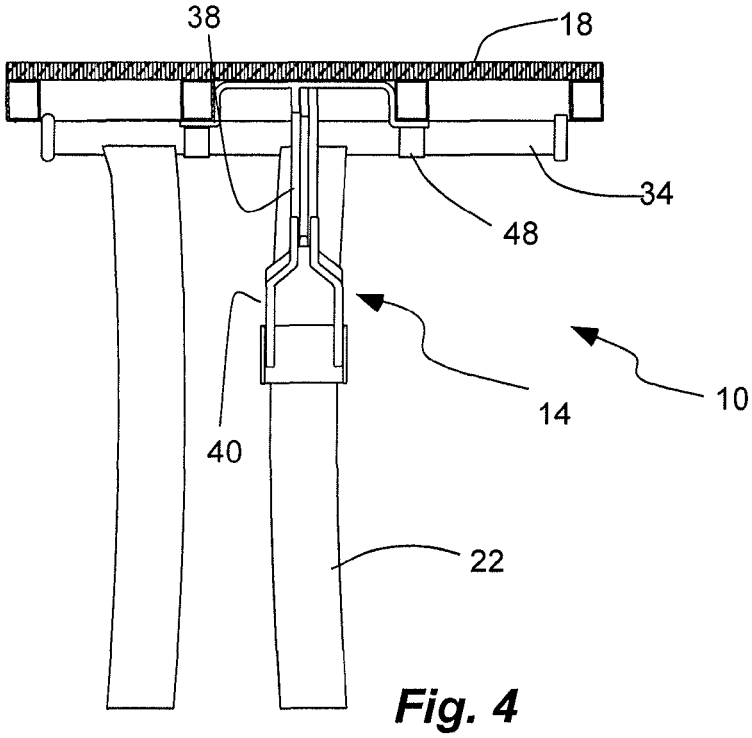
FIG. 4 is a cross-sectional end view of the folding table of FIG. 1*a* taken along line 4 of FIG. 3.

The table 10 has one or more legs or leg assemblies 22 with proximal ends pivotally coupled to a tabletop 18. The tabletop 18 has an upper surface 26 and a bottom 30. The tabletop can include a sheet, such as plywood or laminate, supported by a support frame, such as tubular metal. The support frame can extend around all or some of the perimeter of the sheet and table, and can intersect the perimeter. The legs can be tubular metal and can have a pivot axel 34 on the proximal end that is pivotally coupled to the bottom 30, either or both of the sheet or support frame, of the tabletop. The legs can include a pair of legs or leg assemblies on either side or end of the tabletop. The legs 22 have an open extended orientation, as shown in FIGS. 1*a*, 2*a*, 3 and 4; and a closed retracted orientation, as shown in FIGS. 1*f* and 2*f*. In the open extended orientation (FIGS. 1*a*, 2*a*, 3 and 4), the legs 22 are oriented perpendicular to the tabletop 18 to elevate the tabletop above the support surface with the legs extending between the tabletop and the support surface. The leg can be perpendicular or orthogonal to both the tabletop and the support surface in the open extended orientation. In the closed retracted orientation (1*f* and 20, the legs 22 can be oriented parallel with the tabletop 18. The legs also have one or more intermediate orientations as the legs move between the open extended and closed retracted configurations, as shown in FIGS. 1*b*-*e* and 2*b*-*e*.

A pair of links 38 and 40 is pivotally coupled together, and pivotally coupled in series between the tabletop 18 and the leg 22. The pair of links can be formed of metal. One of the links 38 can have a T-shaped or L-shaped cross-section, with one end coupled to the tabletop or bracket affixed thereto at a pivot 39, and the other end coupled to the other link 40 at a pivot.

The other link 40 can include a pair of links in parallel with one end coupled to the first link 38, and the other end coupled to the leg 22 or bracket affixed thereto. The pair of links has an extended configuration, as shown in FIGS. 1*a*, 2*a*, 3 and 4; and a retracted configuration, as shown in FIGS. 1*f* and 2*f*. The extended configuration (FIGS. 1*a*, 2*a*, 3 and 4) corresponds to the open extended orientation of the leg. In the extended configuration (FIGS. 1*a*, 2*a*, 3 and 4), the pair of links 38 and 40 is aligned with one another in series, and oriented transverse to both the tabletop 18 and the leg 22, to hold the leg in the open extended orientation. The links form an angle of approximately 45 degrees with respect to both the tabletop and the leg in the extended configuration. A sliding lock (not shown) can hold the links in the extended configuration; and the second link 40 abuts to a flange on the distal end 44 of the first link 38 that extends past a common pivot. The links, when aligned in the extended configuration between the tabletop and the leg, resists movement of the leg towards the tabletop, and thus resists movement of the leg to the closed retracted orientation and maintains the leg in the open extended orientation. Sliding the lock up and pushing the links inwardly allows the leg to move towards the closed retracted orientation. The retracted configuration (FIGS. 1*f* and 20 of the links corresponding to the closed retracted orientation of the leg. In the retracted configuration (FIGS. 1*f* and 20, the pair of links is parallel (substantially or essentially parallel) with the leg 22 and the tabletop 18, and one another. As with the legs, the links have one or more intermediate orientations as the links move between the extended and retracted configurations, as shown in FIGS. 1*b-e* and 2*b-e*.

The pair of links 38 and 40, the tabletop 18 (or portion thereof between the pivots) and the leg 22 (or portion thereof between the pivots) form a four-bar, four-pivot linkage, including four pivots and four bars defined between the pivots. The linkage has an open configuration, as shown in FIGS. 1*a*, 2*a*, 3 and 4; and a closed configuration, as shown in FIGS. 1*f* and 2*f*. The open configuration (FIGS. 1*a*, 2*a*, 3 and 4) corresponds to the open extended orientation of the leg, and the extended configuration of the pair of links. In the open configuration, the linkage has a triangular shape. The closed configuration (FIGS. 1*f* and 20 corresponds to the closed retracted orientation of the leg, and the retracted configuration of the pair of links. In the closed configuration, the linkage is folded in upon itself. As with the legs and the links, the linkage has one or more intermediate orientations as the linkage moves between the open and closed configurations, as shown in FIGS. 1*b-e* and 2*b-e*.

As mentioned above, the folding mechanism 14 resists movement of the legs through an intermediate binding configuration between open and closed configurations. The bars of the linkage are sized and the pivots of the linkage are located to resist movement of the linkage through the intermediate binding configuration between the open and closed configurations. The bars of the linkage can be sized and the pivots of the linkage can be located such that one pair of opposite bars slidably abut one another in the binding configuration, forming an interference fit or friction fit or bind, to resist movement of the linkage between the open and closed configurations. At least one of the pair of links can have a length that interferes with another bar of the linkage in the intermediate binding configuration. For example, the first link 38 can have a length between pivots 34 and 39 that is longer than a normal folding mechanism that resists the mechanism from folding normally or equally. As another example, the distal end 44 of the first link 38 can be sized and/or shaped to abut to the leg 22 in the intermediate binding configuration, as shown in FIGS. 1*b-e* and 2*b-e*. The distal end can extend beyond the common pivot.

In addition, at least one of the pivots can be a movable or bendable pivot in the binding configuration to allow the linkage to move through the binding configuration between the open and closed configurations. For example, a flexible and resilient clamp band 48 (or a plurality of clamp bands) can couple the pivot axel 34 of the leg 22 to the bottom 30 of the tabletop 18. The clamp band 48 can be flexible and resilient to allow the pivot axel 34 to move, indicated at 52, in the intermediate binding configuration to allow the linkage to move through the intermediate binding configuration between the open and closed configurations, as shown in FIGS. 1*b-e* and 2*b-e*. Thus, the clamp band 48 can be a spring member biasing the pivot axel 38 towards the linkage, and bendable away from the linkage in the intermediate binding configuration. The movement of the pivot and/or the bending of the clamp band allows the pivot axel to move as the link bears against the leg so that the pivot displaces, allowing movement of the link and the leg past the bind, rather than marring or damaging the link and/or leg. To move the leg 22 from the open extended configuration to the closed retracted configuration (as shown sequentially in FIGS. 1*a-f* or 2*a-f*) for storage can require a user to exert a force F1 on the leg towards the tabletop to overcome the resistance of the folding mechanism, and to overcome the interference fit or friction fit between the link 38 and the leg 22, and to displace or bend the pivot axel and/or clamp band. Similarly, to move the leg 22 from the closed retracted configuration to the open extended configuration (as shown sequentially in FIGS. 1*f-a* or 2*f-a*, or reverse sequentially in FIGS. 1*a-f* or 2*a-f*) for use can require the user to exert an opposite force F2 on the leg away from the tabletop to overcome the resistance of the folding mechanism, and to overcome the interference fit or friction fit between the link 38 and the leg 22, and to displace or bend the pivot axel and/or clamp band. The resistance of the folding mechanism can help maintain the legs in the closed retracted position so that they do not inadvertently fold out. The pivot axel can be a circular, tubular member. The clamp band can be a strip of metal bent to form a U-shaped member to receive the pivot axel, and upper flanges to attach to the bottom of the table top, either or both of the sheet or frame.

Furthermore, all of the pivots and/or all of the links together can provide some bending and/or movement together to allow the linkage to move through the binding configuration between the open and closed configurations. For example, all of the pivots can provide some or even equal amounts of movement to allow the linkage to move through the binding configuration. Similarly, all of the links can bend or flex to allow the linkage to move through the binding configuration. Alternatively, two or more of pivots can provide some movement, or two or more of the links can bend, to allow the linkage to move through the binding configuration.

Although the first link 38 is described above and shown herein as having a length or protrusion to cause binding, it is understood that the second link can be similarly configured. Although pivot 34 is described above and shown herein as providing movement or bending, it is understood that another of the pivots, such as pivot 39, can be similarly configured.

Figure 5:
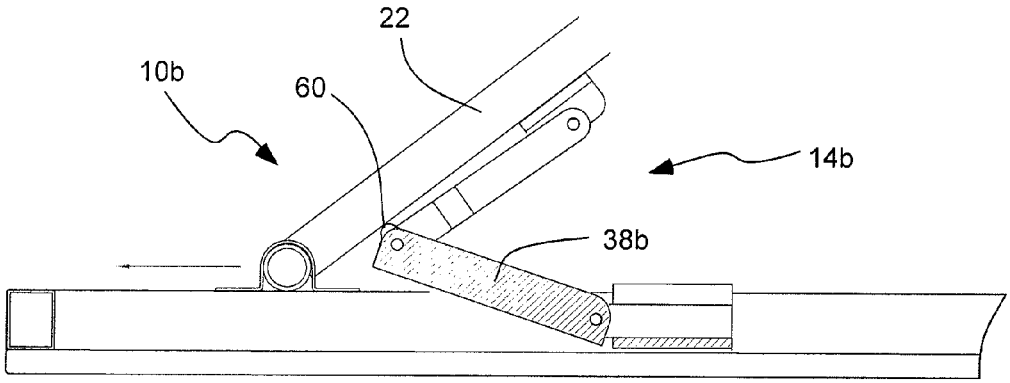
FIG. 5 is a partial schematic cross-sectional front view of another folding table in accordance with an embodiment of the present invention.

Referring to FIG. 5, another table 10*b* and mechanism 14*b* are shown that are similar in most respect to that described above, and which description is herein incorporated by reference. The link 38*b* has a shape or protrusion, indicated at 60, that bears against the leg 22 in the intermediate position.

Figure 6:
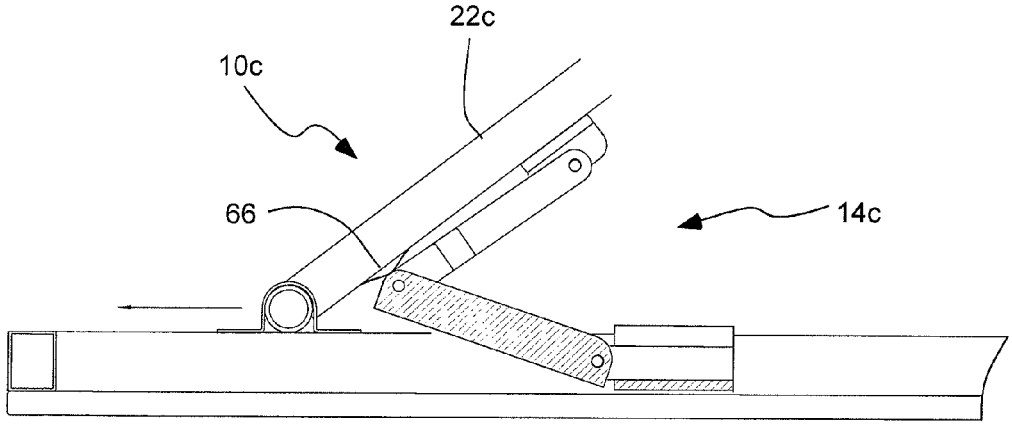
FIG. 6 is a partial schematic cross-sectional front view of another folding table in accordance with an embodiment of the present invention Reference will now be made to the exemplary embodiments illustrated, and specific language will be used herein to describe the same. It will nevertheless be understood that no limitation of the scope of the invention is thereby intended.

Referring to FIG. 6, another table 10*c* and mechanism 14*c* are shown that are similar in most respect to those described above, and which descriptions are herein incorporated by reference. The leg 22*c* has a shape or protrusion, indicated at 66, that bears against the link 38*c* in the intermediate position.

Both the leg and the link can have shapes or protrusions that bear again one another.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A folding table device, comprising:

a) a tabletop with a bottom;

b) a leg with a proximal end pivotally coupled to the bottom of the tabletop and having:

i) an open extended orientation with the leg oriented perpendicular to the tabletop to elevate the tabletop above a support surface with the leg extending between the tabletop and the support surface, and ii) a closed retracted orientation with the leg oriented parallel with the tabletop;

c) a pair of links pivotally coupled together and pivotally coupled in series between the tabletop and the leg, the pair of links having:

i) an extended configuration corresponding to the open extended orientation of the leg in which the pair of links are aligned with one another in series and oriented transverse to both the tabletop and the leg to hold the leg in the open extended orientation, and ii) a retracted configuration corresponding to the closed retracted orientation of the leg in which the pair of links are parallel with the leg and the tabletop;

d) the pair of links, the tabletop and the leg forming a four-bar, four-pivot linkage including four pivots and four bars defined between the pivots and having:

i) an open configuration corresponding to the open extended orientation of the leg and the extended configuration of the pair of links, and ii) a closed configuration corresponding to the closed retracted orientation of the leg and the retracted configuration of the pair of links;

e) one of the pair of links slidably abuts the leg or the tabletop to resist movement of the linkage through an intermediate binding configuration between the open and closed configurations; and f) at least one of the pivots or at least one of the bars or both being movable or bendable or both in the binding configuration to allow the linkage to move through the binding configuration between the open and closed configurations.

2. A device in accordance with claim 1, further comprising:

the bars of the linkage being sized and the pivots of the linkage being located such that the one of the pair of links slidably abut the leg in the intermediate binding configuration forming an interference fit or friction fit to resist movement of the linkage between the open and closed configurations.

3. A device in accordance with claim 1, further comprising:

the leg having a pivot axel on the proximal end thereof;

a flexible and resilient clamp band coupling the pivot axel of the leg to the bottom of the tabletop; and the clamp band being flexible and resilient to allow the pivot axel to move in the intermediate binding configuration to allow the linkage to move through the intermediate binding configuration between the open and closed configurations.

4. A device in accordance with claim 3, wherein the clamp band is a spring member biasing the pivot axel towards the linkage, and bendable away from the linkage in the intermediate binding configuration.

5. A device in accordance with claim 1, wherein the one of the pair of links has a length that interferes with the leg in the intermediate binding configuration.

6. A device in accordance with claim 1, wherein at least one of the bars in the linkage has a length that causes the linkage to bind in the intermediate binding configuration.

7. A device in accordance with claim 1, wherein at least one of the bars has a shape or projection that interferes with another bar of the linkage in the intermediate binding configuration.

8. A folding table device, comprising:

a) a tabletop with a bottom;

b) a leg with a proximal end pivotally coupled to the bottom of the tabletop and having:

i) an open extended orientation with the leg oriented perpendicular to the tabletop to elevate the tabletop above a support surface with the leg extending between the tabletop and the support surface, and ii) a closed retracted orientation with the leg oriented parallel with the tabletop;

c) a pair of links pivotally coupled together and pivotally coupled in series between the tabletop and the leg, the pair of links having:

i) an extended configuration corresponding to the open extended orientation of the leg in which the pair of links are aligned with one another in series and oriented transverse to both the tabletop and the leg to hold the leg in the open extended orientation, and ii) a retracted configuration corresponding to the closed retracted orientation of the leg in which the pair of links are parallel with the leg and the tabletop;

d) the pair of links, the tabletop and the leg forming a four-bar, four-pivot linkage including four pivots and four bars defined between the pivots and having:

i) an open configuration corresponding to the open extended orientation of the leg and the extended configuration of the pair of links, and ii) a closed configuration corresponding to the closed retracted orientation of the leg and the retracted configuration of the pair of links; and e) the bars of the linkage being sized and the pivots of the linkage being located such that one of the pair of links slidably abut the leg of the tabletop in an intermediate binding configuration between the open and closed configurations forming an interference fit or friction fit to resist movement of the linkage between the open and closed configurations.

9. A device in accordance with claim 8, further comprising:

at least one of the pivots being a movable or bendable pivot in the intermediate binding configuration to allow the linkage to move through the intermediate binding configuration between the open and closed configurations.

10. A device in accordance with claim 8, further comprising:

the leg having a pivot axel on the proximal end thereof;

a flexible and resilient clamp band coupling the pivot axel of the leg to the bottom of the tabletop; and the clamp band being flexible and resilient to allow the pivot axel to move relative to the linkage in the intermediate binding configuration to allow the linkage to move through the intermediate binding configuration between the open and closed configurations.

11. A device in accordance with claim 10, wherein the clamp band is a spring member biasing the pivot axel towards the linkage, and bendable away from the linkage in the intermediate binding configuration.

12. A device in accordance with claim 8, wherein the one of the pair of links has a length that interferes with the leg in the intermediate binding configuration.

13. A device in accordance with claim 8, wherein at least one of the bars has a shape or projection that interferes with another bar of the linkage in the intermediate binding configuration.

14. A folding table device, comprising:

a) a tabletop with a bottom;

b) a leg with a pivot axel at a proximal end pivotally coupled to the bottom of the tabletop and having:

i) an open extended orientation with the leg oriented perpendicular to the tabletop to elevate the tabletop above a support surface with the leg extending between the tabletop and the support surface, and ii) a closed retracted orientation with the leg oriented parallel with the tabletop;

c) a flexible and resilient clamp band coupling the pivot axel of the leg to the bottom of the tabletop;

d) a pair of links pivotally coupled together and pivotally coupled in series between the tabletop and the leg, the pair of links having:

i) an extended configuration corresponding to the open extended orientation of the leg in which the pair of links are aligned with one another in series and oriented transverse to both the tabletop and the leg to hold the leg in the open extended orientation, and ii) a retracted configuration corresponding to the closed retracted orientation of the leg in which the pair of links are parallel with the leg and the tabletop;

e) the pair of links, the tabletop and the leg forming a four-bar, four-pivot linkage including four pivots and four bars defined between the pivots and having:

i) an open configuration corresponding to the open extended orientation of the leg and the extended configuration of the pair of links, and ii) a closed configuration corresponding to the closed retracted orientation of the leg and the retracted configuration of the pair of links;

f) the bars of the linkage being sized and the pivots of the linkage being located such that one of the pair of links abuts the leg in an intermediate binding configuration between the open and closed configurations to resist movement of the linkage between the open and closed configurations; and g) the clamp band being flexible and resilient to allow the pivot axel to move relative to the linkage in the intermediate binding configuration to allow the linkage to move through the intermediate binding configuration between the open and closed configurations.

15. A device in accordance with claim 14, wherein the clamp band is a spring member biasing the pivot axel towards the linkage, and bendable away from the linkage in the intermediate binding configuration.

16. A device in accordance with claim 14, wherein at least one of the pair of links has a length that interferes with another bar of the linkage in the intermediate binding configuration.

17. A device in accordance with claim 14, wherein at least one of the bars has a shape or projection that interferes with another bar of the linkage in the intermediate binding configuration.

18. A folding table device, comprising:

a) a tabletop with a bottom;

b) a leg pivotally coupled to the bottom of the tabletop;

c) a pair of links pivotally coupled together and pivotally coupled in series between the tabletop and the leg;

d) the pair of links, the tabletop and the leg forming a four-bar, four-pivot linkage including four pivots and four bars defined between the pivots; and e) one of the links slidably abuts the leg or the tabletop to resist movement of the linkage through an intermediate binding configuration between open and closed configurations.

19. A device in accordance with claim 18, wherein at least one of the pivots is a movable or bendable pivot in the intermediate binding configuration to allow the linkage to move through the intermediate binding configuration between the open and closed configurations.

20. A device in accordance with claim 19, further comprising:

a flexible and resilient clamp band coupling a pivot axel of the leg to the bottom of the tabletop; and the clamp band being flexible and resilient to allow the pivot axel to move in the intermediate binding configuration to allow the linkage to move through the intermediate binding configuration between the open and closed configurations.

21. A device in accordance with claim 18, wherein one of the pair of links abuts the leg in the intermediate binding configuration between the open and closed configurations to resist movement of the linkage between the open and closed configurations.

22. A device in accordance with claim 1, further comprising:

the intermediate binding configuration binds the leg in the closed retracted position.

* * * * *